US009441413B1

(12) United States Patent
Fang

(10) Patent No.: US 9,441,413 B1
(45) Date of Patent: Sep. 13, 2016

(54) MULTILAYER KICK PLATE AND METHOD FOR PREPARING THE SAME

(71) Applicant: WELLSCO INTERNATIONAL GROUP CO., LTD., Hangzhou, Zhejiang Province (CN)

(72) Inventor: Shih-Hao Fang, Taipei (TW)

(73) Assignee: Wellsco International Group Co., Ltd., Hangzhou, Zhejiang Province (CN)

( * ) Notice: Subject to any disclaimer, the term of this patent is extended or adjusted under 35 U.S.C. 154(b) by 0 days.

(21) Appl. No.: 14/722,965

(22) Filed: May 27, 2015

(51) Int. Cl.
*E06B 3/30* (2006.01)

(52) U.S. Cl.
CPC . *E06B 3/30* (2013.01); *Y10T 16/86* (2015.01)

(58) Field of Classification Search
CPC ..... E06B 3/30; E06B 3/7001; Y10T 16/86; Y10T 29/49885; B60R 13/02; B60R 13/04; B60R 13/043; B60J 11/06; B29C 65/02; B23P 15/00
USPC ..... 16/402; 296/199, 1.07; 156/583.1; 49/460; 29/458
See application file for complete search history.

(56) References Cited

U.S. PATENT DOCUMENTS

| | | | | |
|---|---|---|---|---|
| 2,051,531 | A * | 8/1936 | Roberts | E06B 7/232 16/402 |
| D241,315 | S * | 9/1976 | Hoskins | D11/136 |
| 2011/0062735 | A1* | 3/2011 | Erickson | B60R 13/02 296/1.07 |
| 2015/0086597 | A1* | 3/2015 | Mallak | A01N 59/16 424/407 |

* cited by examiner

*Primary Examiner* — William Miller
(74) *Attorney, Agent, or Firm* — Fishman & Associates, LLC.

(57) ABSTRACT

Provided is a multilayer kick plate, comprising a thin strip, a supporting strip, and a bonding film. The thin strip has a front surface and a back surface, and the front surface of the thin strip is polished by abrasive paper ranging from #800 to #890. The supporting strip has a bonding surface. The bonding film is mounted between the back surface of the thin strip and the bonding surface of the supporting strip. With said supporting strip and bonding film, the thin strip can be designed to be much thinner than the conventional thin strip, such that the production cost of the multilayer kick plate is reduced.

3 Claims, 5 Drawing Sheets

MULTILAYER KICK PLATE AND METHOD FOR PREPARING THE SAME

BACKGROUND OF THE INVENTION

1. Field of the Invention

The present invention relates to a kick plate, especially relates to a kick plate with multilayer structure.

2. Description of the Prior Art(s)

A kick plate is installed on the bottom of a door to prevent marring of the finish by shoe marks. A conventional kick plate is consisted of a single layer plate. The single layer plate is prepared from a bulk material having a thickness greater than 1 mm. The bulk material is pressed and then polished to form a 1 mm-thick single layer plate. Since the cost of the bulk material is increased with its thickness, the production cost of the conventional kick plate is also increased. Therefore, there is a need to reduce the production cost of the conventional kick plate.

Furthermore, the single layer plate generates internal stress within when pressed and polished. If the internal stress cannot be effectively diminished, said single layer plate may be bended to form a non-even surface of the conventional kick plate.

SUMMARY OF THE INVENTION

The objective of the present invention is to reduce the production cost of the kick plate.

To achieve the foresaid objective, the present invention provides a multilayer kick plate. The multilayer kick plate comprises a thin strip, a supporting strip, and a bonding film.

The thin strip is selected from the group consisting of aluminum, aluminum-magnesium alloy, copper-zinc alloy (also called brass), and any combinations thereof. A thickness of the thin strip ranges from 0.25 mm to 0.28 mm. A hardness of the thin strip ranges from 9 HV to 10 HV. The thin strip has a front surface and a back surface. The front surface of the thin strip is polished by abrasive paper ranging from #800 to #890.

The supporting strip comprises aluminum. The thickness of the supporting strip ranges from 0.7 mm to 0.75 mm. The supporting strip has a bonding surface.

The bonding film is mounted between the back surface of the thin strip and the bonding surface of the supporting strip. The bonding film is selected from the group consisting of polyolefin, polyurethane, vinyl acetate copolymer, phenylethene, and any combinations thereof. A thickness of the bonding film ranges from 0.03 mm to 0.05 mm. A density of the bonding film ranges from 0.93 g/mm$^3$ to 0.95 g/mm$^3$. A tensile strength of the bonding film ranges from 14 MPa to 17 MPa. An elongation rate of the bonding film ranges from 280% to 350%. A melting point of the bonding film ranges from 95° C. to 110° C. By adopting the thin strip thinner than 1 mm in combination with the bonding film and the supporting strip, the production cost of the multilayer kick plate is reduced. Furthermore, the bonding film renders the multilayer kick plate a buffer capability.

Preferably, the thin strip is consisted of aluminum-magnesium alloy and a weight percentage of magnesium ranging from 3 wt % to 5 wt % based on the total weight of the thin strip.

The present invention further provides a method for preparing the foresaid multilayer kick plate. The method for preparing the multilayer kick plate comprises:

preparing a supporting strip and a thin strip, the supporting strip comprising aluminum, a thickness of the supporting strip ranging from 0.7 mm to 0.75 mm, the supporting strip having a bonding surface, and the thin strip selected from the group consisting of aluminum, aluminum-magnesium alloy, copper-zinc alloy, and any combinations thereof, a thickness of the thin strip ranging from 0.25 mm to 0.28 mm, a hardness of the thin strip ranging from 9 HV to 10 HV, the thin strip having a front surface and a back surface, the front surface of the thin strip polished by abrasive paper ranging from #800 to #890;

coating a bonding film on the bonding surface of the supporting strip, the bonding film selected from the group consisting of polyolefin, polyurethane, vinyl acetate copolymer, phenylethene, and any combinations thereof, a thickness of the bonding film ranging from 0.03 mm to 0.05 mm, a density of the bonding film ranging from 0.93 g/mm$^3$ to 0.95 g/mm$^3$, a tensile strength of the bonding film ranging from 14 MPa to 17 MPa, an elongation rate of the bonding film ranging from 280% to 350%, a melting point of the bonding film ranging from 95° C. to 110° C.;

covering the bonding film with the back surface of the thin strip to form a multilayer structure, the multilayer structure having a front side and a back side; and heating the multilayer structure at a temperature ranging from 120° C. to 150° C. and compressing simultaneously the front side and the back side of the multilayer with a pressure ranging from 3.5 kg/mm$^2$ to 4.5 kg/mm$^2$ to form the multilayer kick plate.

The method for preparing the multilayer kick plate eliminates the internal stresses of the thin strip and the supporting strip by combining the thin strip and the supporting strip in a proper direction; that is to say, the multilayer kick plate produced according to said method has an even surface.

Furthermore, the thermal expansion coefficient of aluminum-based material is proportional to its thickness, and the aluminum-based material with larger thickness is deformed more greatly after heating. Therefore, reducing the thickness of the thin strip to less than 0.3 mm mitigates the expansion after thermal treatment, thereby ensuring the quality of the kick plate of the present invention.

Other objectives, advantages and novel features of the invention will become more apparent from the following detailed description when taken in conjunction with the accompanying drawings.

DETAILED DESCRIPTION OF THE PREFERRED EMBODIMENTS

The present invention provides a method for preparing a multilayer kick plate. The method for preparing the multilayer kick plate was described as follows.

Figure 1:
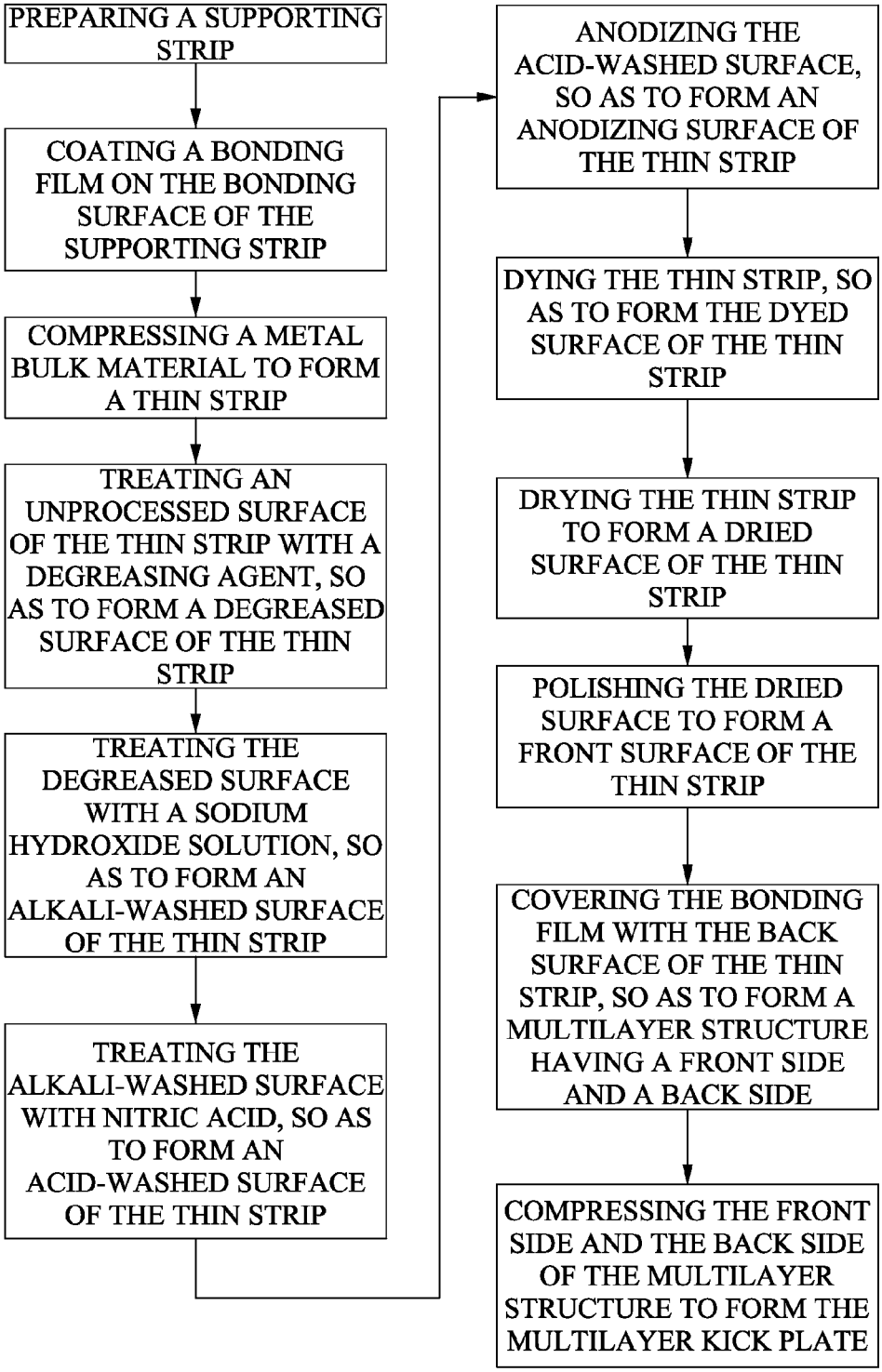
FIG. 1 is a flow chart for preparing a multilayer kick plate of the present invention.
Figure 2:
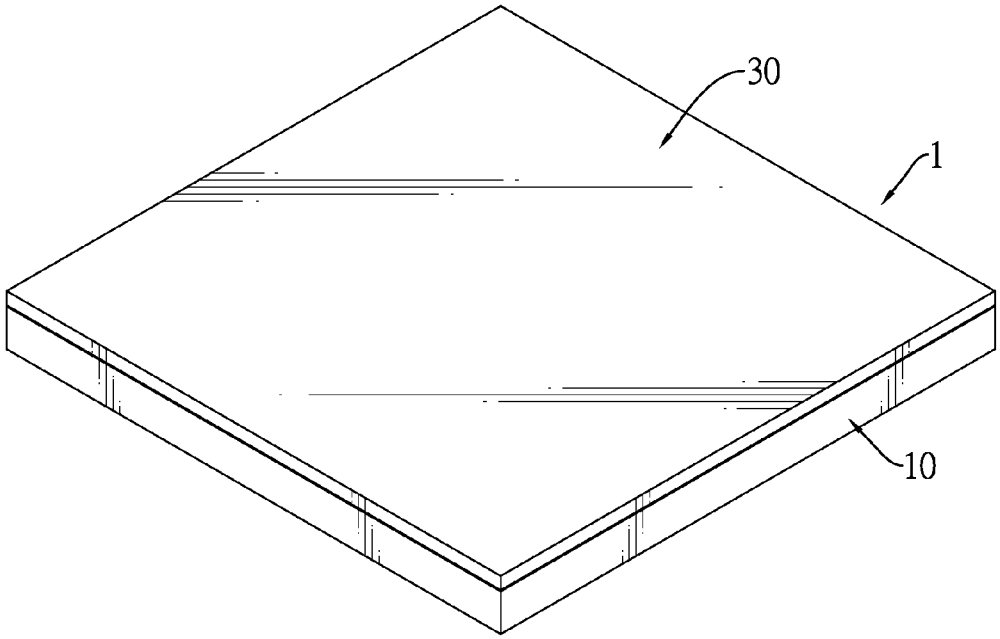
FIG. 2 is a perspective view of the multilayer kick plate of the present invention.
Figure 3:
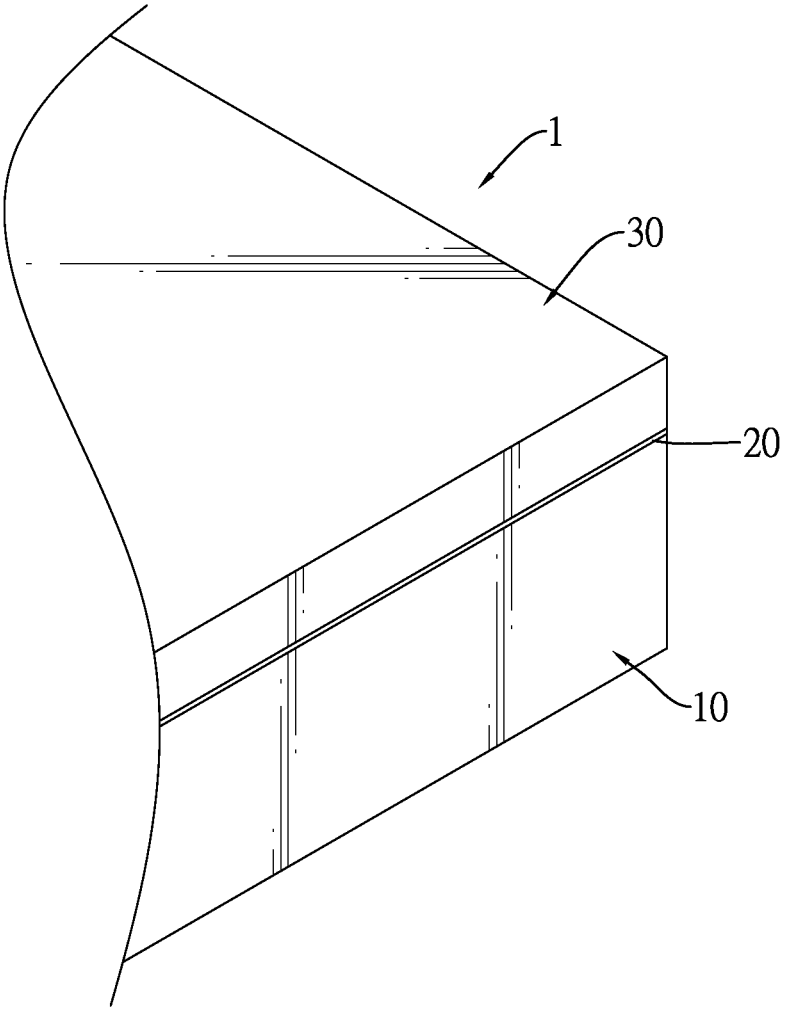
FIG. 3 is a partial enlarged view of the multilayer kick plate of the present invention.
Figure 4:
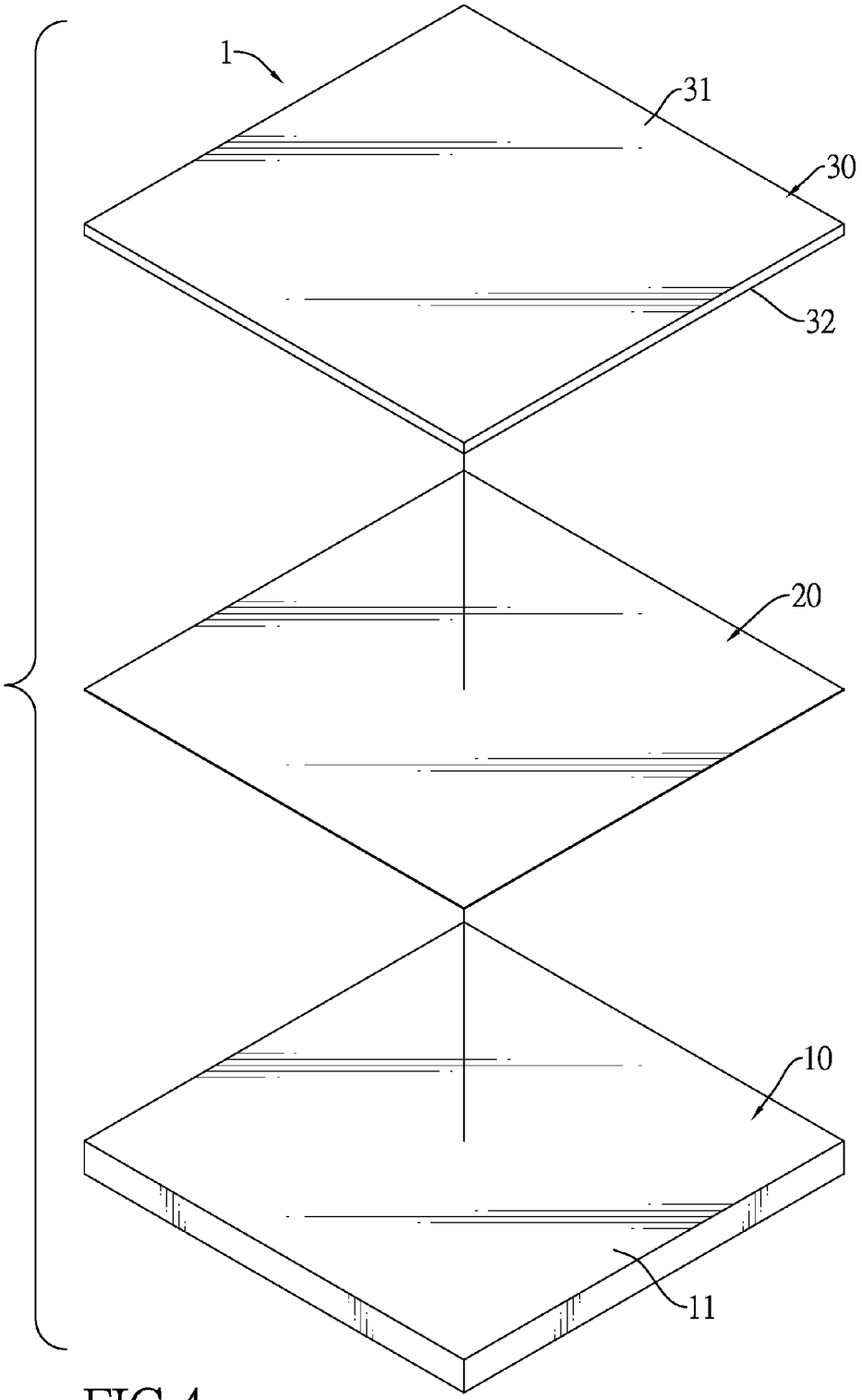
FIG. 4 is an exploded perspective view of the multilayer kick plate of the present invention.
Figure 5:
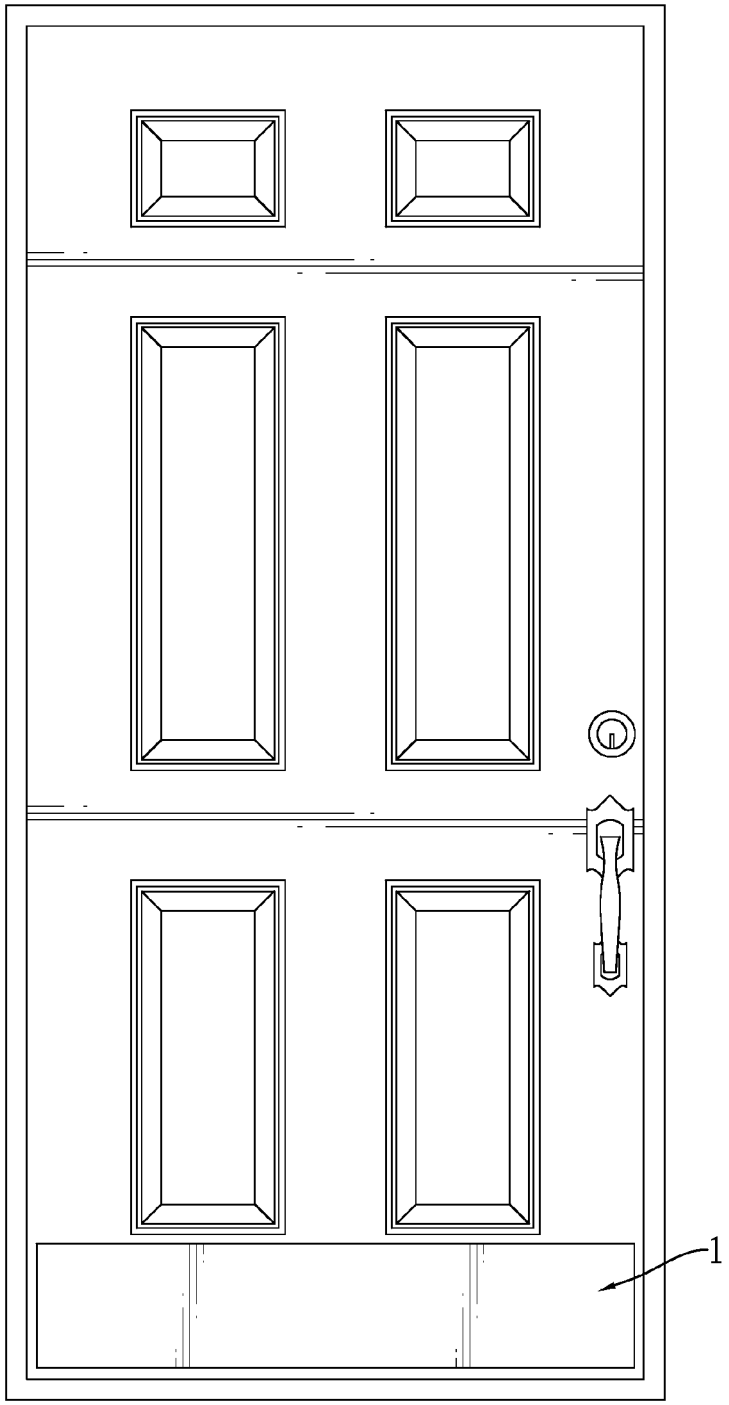
FIG. 5 is an operational view of the multilayer kick plate of the present invention mounted on the bottom of a door.

Firstly, with reference to FIG. 1, a supporting strip made of aluminum was prepared. A thickness of the supporting strip was 0.72 mm. The supporting strip had a bonding surface.

A bonding film made of polyolefin, polyurethane, vinyl acetate copolymer, and phenylethene was coated on the bonding surface of the supporting strip. The bonding film had a thickness of 0.05 mm, a density of 0.94 g/mm$^3$, a tensile strength of 15 MPa, an elongation rate of the bonding film 310%, and a melting point ranging from 95° C. to 110° C.

A metal bulk material made of aluminum was prepared. The metal bulk material was compressed to form a thin strip having an unprocessed surface and a back surface.

The unprocessed surface of the thin strip was treated with a degreasing agent to form a degreased surface of the thin strip. A concentration of the degreasing agent was 4%. The degreased surface of the thin strip was sequentially washed by pure water and treated with a sodium hydroxide solution to form an alkali-washed surface of the thin strip. A concentration of the sodium hydroxide solution was 200 g/L. The alkali-washed surface of the thin strip was treated with nitric acid to form an acid-washed surface of the thin strip. A concentration of the nitric acid was 20 mL/L. The acid-washed surface of the thin strip was then anodized by immersing the thin strip in sulfuric acid at 20° C. and applying a current of 1.4 A/dm$^2$ for 30 min, so as to form an anodizing surface of the thin strip. A concentration of the sulfuric acid was 25%. Subsequently, the anodizing surface of the thin strip was treated with a dyeing process to form a dyed surface of the thin strip.

The thin strip was then dyed by immersing in a dye solution and by applying a current of 10 A/dm$^2$ to form the dyed surface of the thin strip. The dye solution comprised copper(II) sulfate as a dye compound and sulfuric acid. A concentration of the sulfuric acid was 25%.

The dyed surface was treated with pure water at a temperature of 85° C. to form a pore-sealed surface. The thin strip was sequentially immersed in 95% ethanol and was dried at a temperature of 95° C. to form a dried surface of the thin strip. The dried surface was polished to form a front surface of the thin strip. The thickness of the thin strip was 0.26 mm. The hardness of the thin strip was 9 HV. The front surface of the thin strip is polished by abrasive paper #800.

The back surface of the thin strip is covered on the bonding film to form a multilayer structure. The multilayer structure had a front side and a back side. The front side was located at the front surface of the thin strip, and the back side was located at a surface opposite the bonding surface of the supporting strip.

The front side and the back side of the multilayer structure were compressed at a temperature of 135° C. and with a pressure of 4 kg/mm$^2$ for 30 seconds to form the multilayer kick plate.

With reference to FIG. 2 to FIG. 5, the multilayer kick plate 1 comprised the supporting strip 10, the bonding film 20, and the thin strip 30. The properties of the supporting strip 10, the bonding film 20, and the thin strip 30 were described above. The supporting strip 10 had the bonding surface 11. The bonding film 20 was coated on the bonding surface 11. The thin strip 30 had the front surface 31 and the back surface 32, and the back surface 32 covered the bonding film 20.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A multilayer kick plate for a door comprising:

a thin strip selected from the group consisting of aluminum, aluminum-magnesium alloy, copper-zinc alloy, and any combinations thereof, a thickness of the thin strip ranging from 0.25 mm to 0.28 mm, a hardness of the thin strip ranging from 9 HV to 10 HV, the thin strip having a front surface and a back surface, the front surface of the thin strip polished by abrasive paper ranging from #800 to #890;

a supporting strip comprising aluminum, a thickness of the supporting strip ranging from 0.7 mm to 0.75 mm, the supporting strip having a bonding surface; and a bonding film mounted between the back surface of the thin strip and the bonding surface of the supporting strip, the bonding film selected from the group consisting of polyolefin, polyurethane, vinyl acetate copolymer, phenylethene, and any combinations thereof, a thickness of the bonding film ranging from 0.03 mm to 0.05 mm, a density of the bonding film ranging from 0.93 g/mm$^3$ to 0.95 g/mm$^3$, a tensile strength of the bonding film ranging from 14 MPa to 17 MPa, an elongation rate of the bonding film ranging from 280% to 350%, a melting point of the bonding film ranging from 95° C. to 110° C.

2. The multilayer kick plate for the door as claimed in claim 1, wherein the thin strip is consisted of aluminum-magnesium alloy and a weight percentage of magnesium ranges from 3 wt % to 5 wt % based on the total weight of the thin strip.

3. A method for preparing a multilayer kick plate for a door comprising:

preparing a supporting strip and a thin strip, the supporting strip comprising aluminum, a thickness of the supporting strip ranging from 0.7 mm to 0.75 mm, the supporting strip having a bonding surface, the thin strip selected from the group consisting of aluminum, aluminum-magnesium alloy, copper-zinc alloy, and any combinations thereof, a thickness of the thin strip ranging from 0.25 mm to 0.28 mm, a hardness of the thin strip ranging from 9 HV to 10 HV, the thin strip having a front surface and a back surface, the front surface of the thin strip polished by abrasive paper ranging from #800 to #890;

coating a bonding film on the bonding surface of the supporting strip, the bonding film selected from the group consisting of polyolefin, polyurethane, vinyl acetate copolymer, phenylethene, and any combinations thereof, a thickness of the bonding film ranging from 0.03 mm to 0.05 mm, a density of the bonding film ranging from 0.93 g/mm$^3$ to 0.95 g/mm$^3$, a tensile strength of the bonding film ranging from 14 MPa to 17 MPa, an elongation rate of the bonding film ranging from 280% to 350%, a melting point of the bonding film ranging from 95° C. to 110° C.;

covering the bonding film with the back surface of the thin strip to form a multilayer structure, the multilayer structure having a front side and a back side; and heating the multilayer structure at a temperature ranging from 120° C. to 150° C. and compressing simultaneously the front side and the back side of the multilayer structure with a pressure ranging from 3.5 $kg/mm^2$ to 4.5 $kg/mm^2$.

* * * * *